US009885138B2

(12) United States Patent
Kim et al.

(10) Patent No.: US 9,885,138 B2
(45) Date of Patent: Feb. 6, 2018

(54) LAUNDRY TREATMENT APPARATUS

(71) Applicant: LG ELECTRONICS INC., Seoul (KR)

(72) Inventors: Naeun Kim, Seoul (KR); Mingyu Jo, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 67 days.

(21) Appl. No.: 14/763,424

(22) PCT Filed: Dec. 3, 2014

(86) PCT No.: PCT/KR2014/011766

§ 371 (c)(1),
(2) Date: Jul. 24, 2015

(87) PCT Pub. No.: WO2016/088912

PCT Pub. Date: Jun. 9, 2016

(65) Prior Publication Data

US 2016/0355969 A1 Dec. 8, 2016

(51) Int. Cl.
*D06F 39/02* (2006.01)
*D06F 39/12* (2006.01)

(52) U.S. Cl.
CPC ..... *D06F 39/028* (2013.01); *D06F 39/02* (2013.01); *D06F 39/12* (2013.01)

(58) Field of Classification Search
CPC ..... D06F 39/028
See application file for complete search history.

(56) References Cited

U.S. PATENT DOCUMENTS

| | | | | |
|---|---|---|---|---|
| 2008/0229790 | A1 | 9/2008 | Kim et al. | |
| 2011/0174021 | A1 | 7/2011 | Lee et al. | |
| 2012/0103028 | A1* | 5/2012 | Lee | D06F 29/00 68/17 R |
| 2014/0096572 | A1 | 4/2014 | Kim et al. | |

FOREIGN PATENT DOCUMENTS

| | | | |
|---|---|---|---|
| CN | 101298733 | A | 11/2008 |
| CN | 101307557 | A | 11/2008 |
| CN | 103726272 | A | 4/2014 |
| EP | 0655523 | A1 | 5/1995 |
| KR | 10-0758363 | B1 | 9/2007 |
| KR | 10-2011-0099917 | A | 9/2011 |
| KR | 10-2014-0046181 | A | 4/2014 |
| KR | 10-2014-0046182 | A | 4/2014 |
| WO | WO 2013/169005 | A1 | 11/2013 |

* cited by examiner

*Primary Examiner* — Jason Ko
(74) *Attorney, Agent, or Firm* — Birch, Stewart, Kolasch & Birch, LLP

(57) ABSTRACT

There is disclosed a laundry treatment apparatus including, a cabinet comprising a laundry entrance hole configured to load laundry into the cabinet, a tub provided in the cabinet and configured to store washing water therein, the tub comprising a tub hole in communication with the laundry entrance hole, a drum rotatably provided in the tub and configured to receive the laundry loaded via the tub hole, a detergent supply unit provided under the laundry entrance hole, in communication with the tub, and configured to store detergent therein, and a water supply unit configured to supply water to the detergent supply unit.

7 Claims, 7 Drawing Sheets

[Fig. 1]
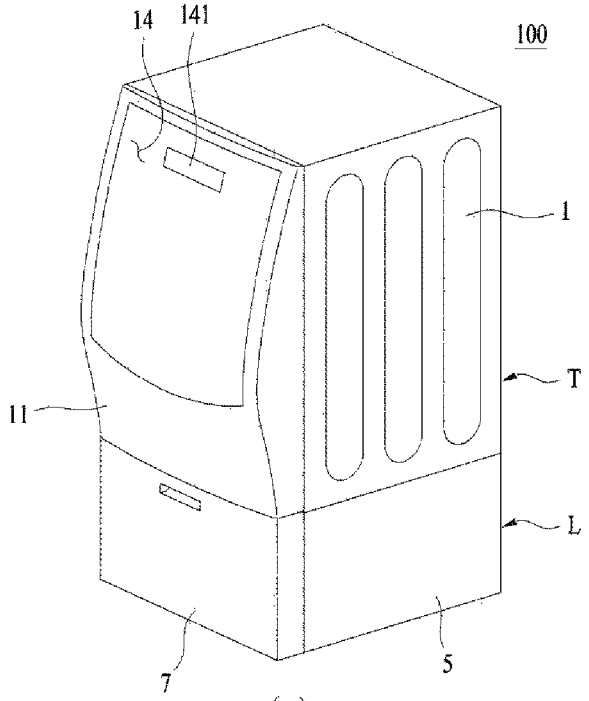
(a)
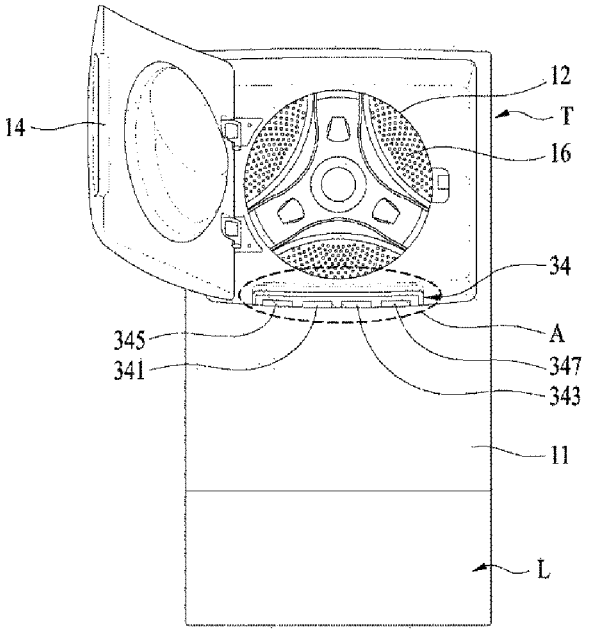
(b)

[Fig. 2]
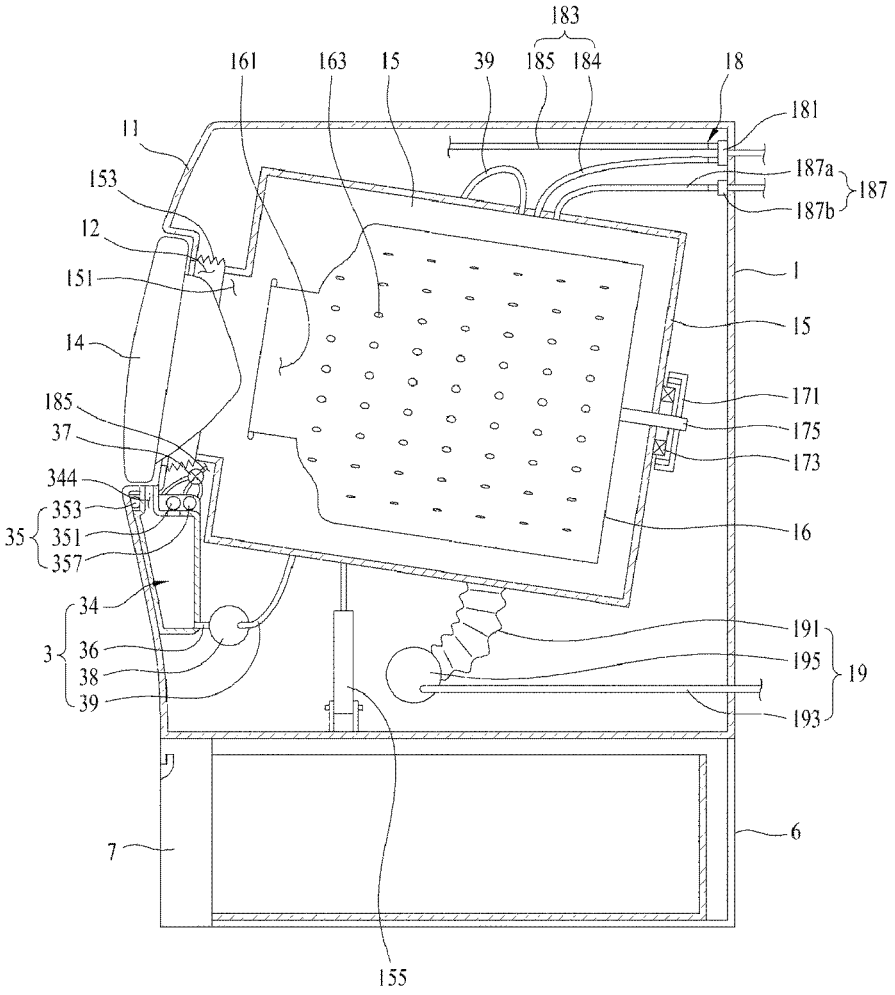

[Fig. 3]
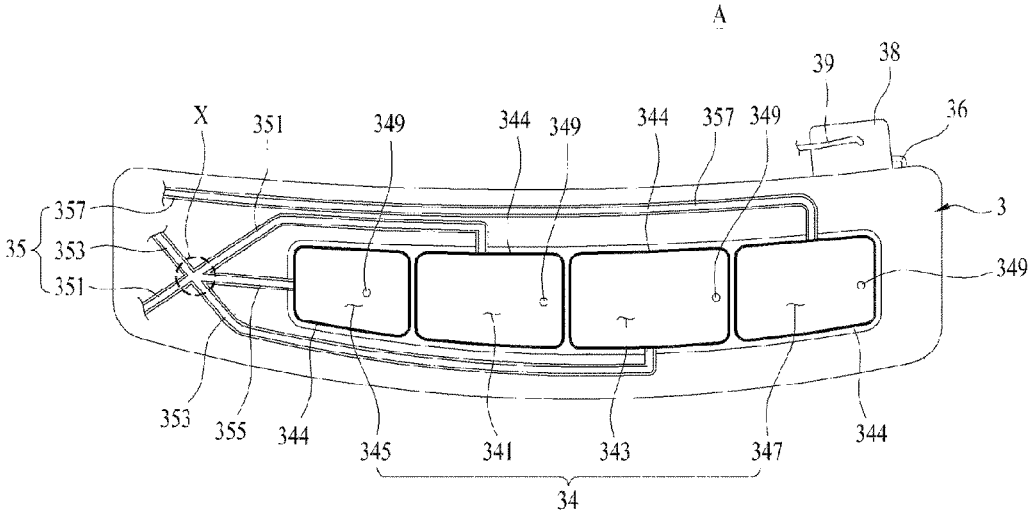

[Fig. 4]
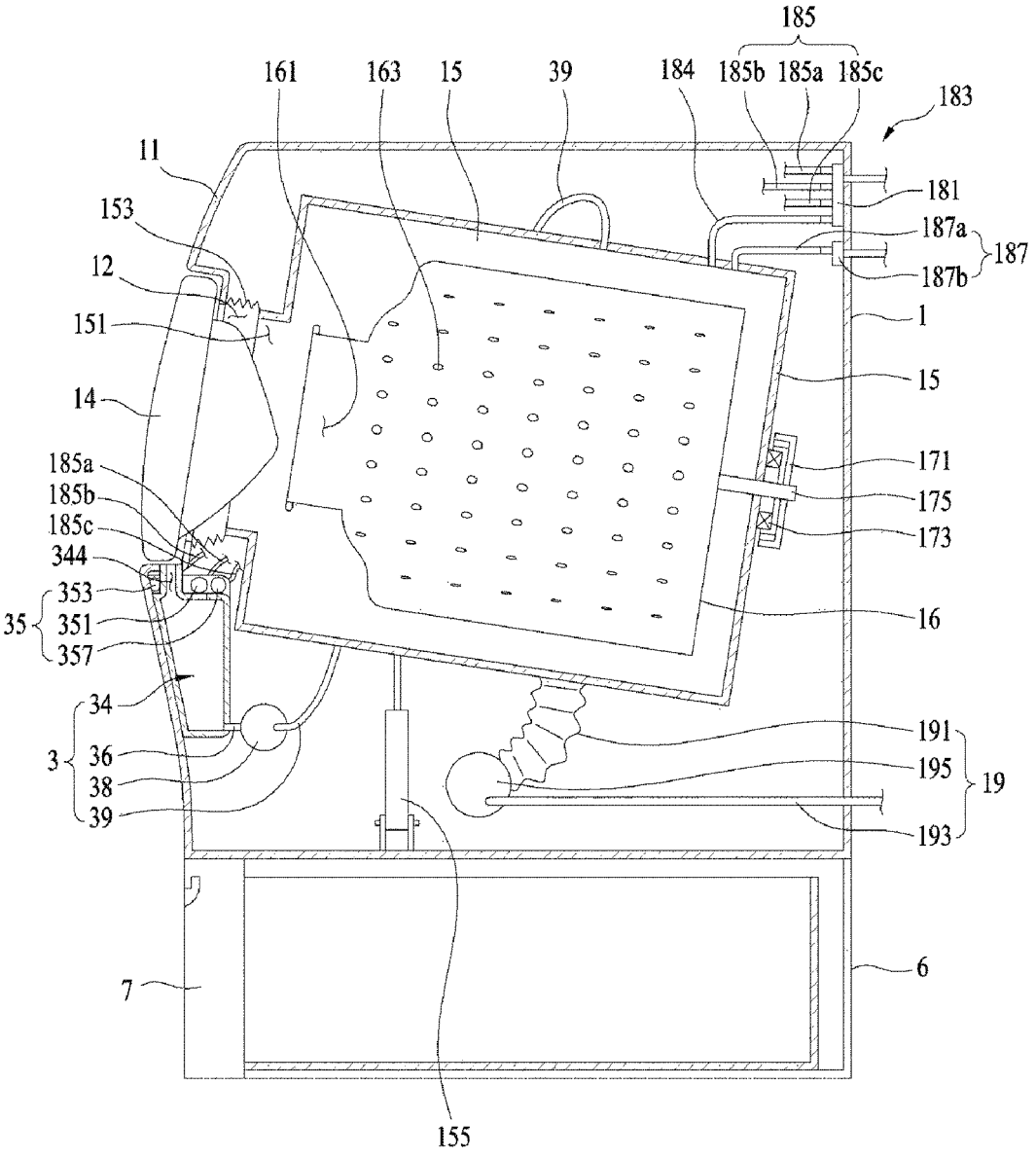

[Fig. 5]
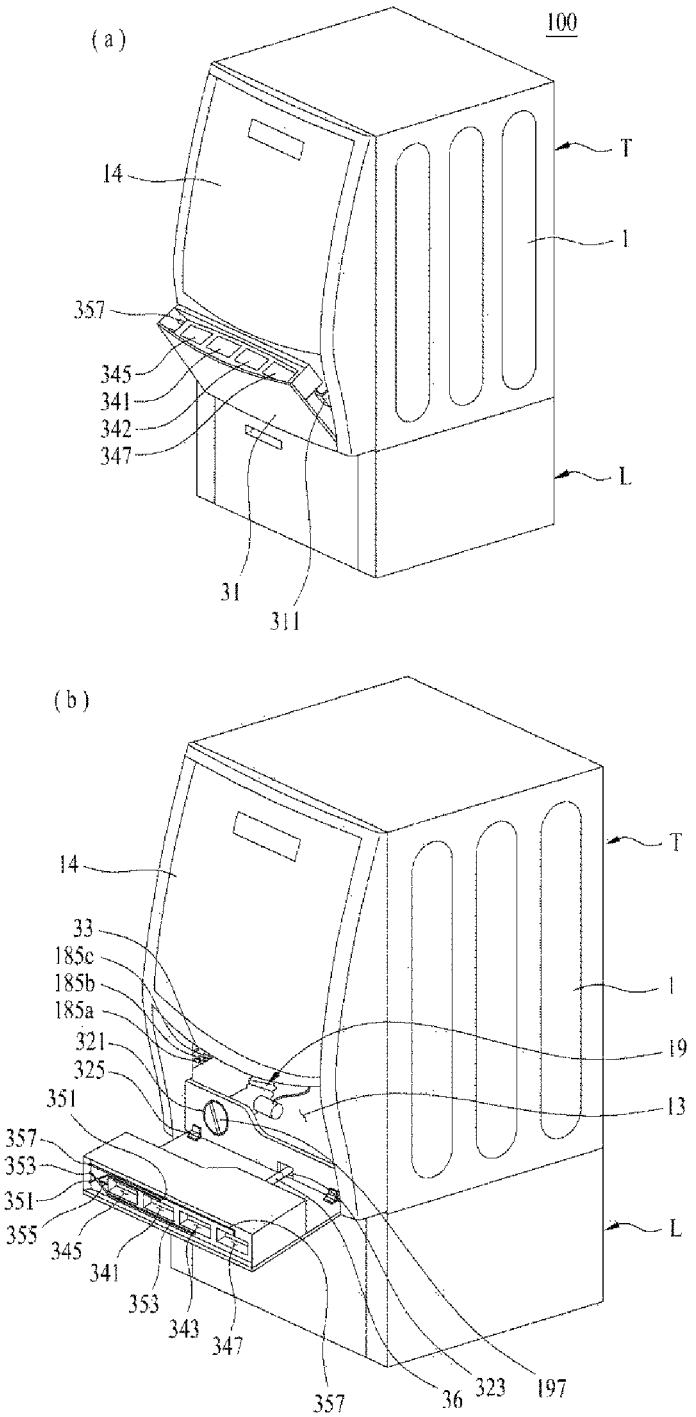

[Fig. 6]
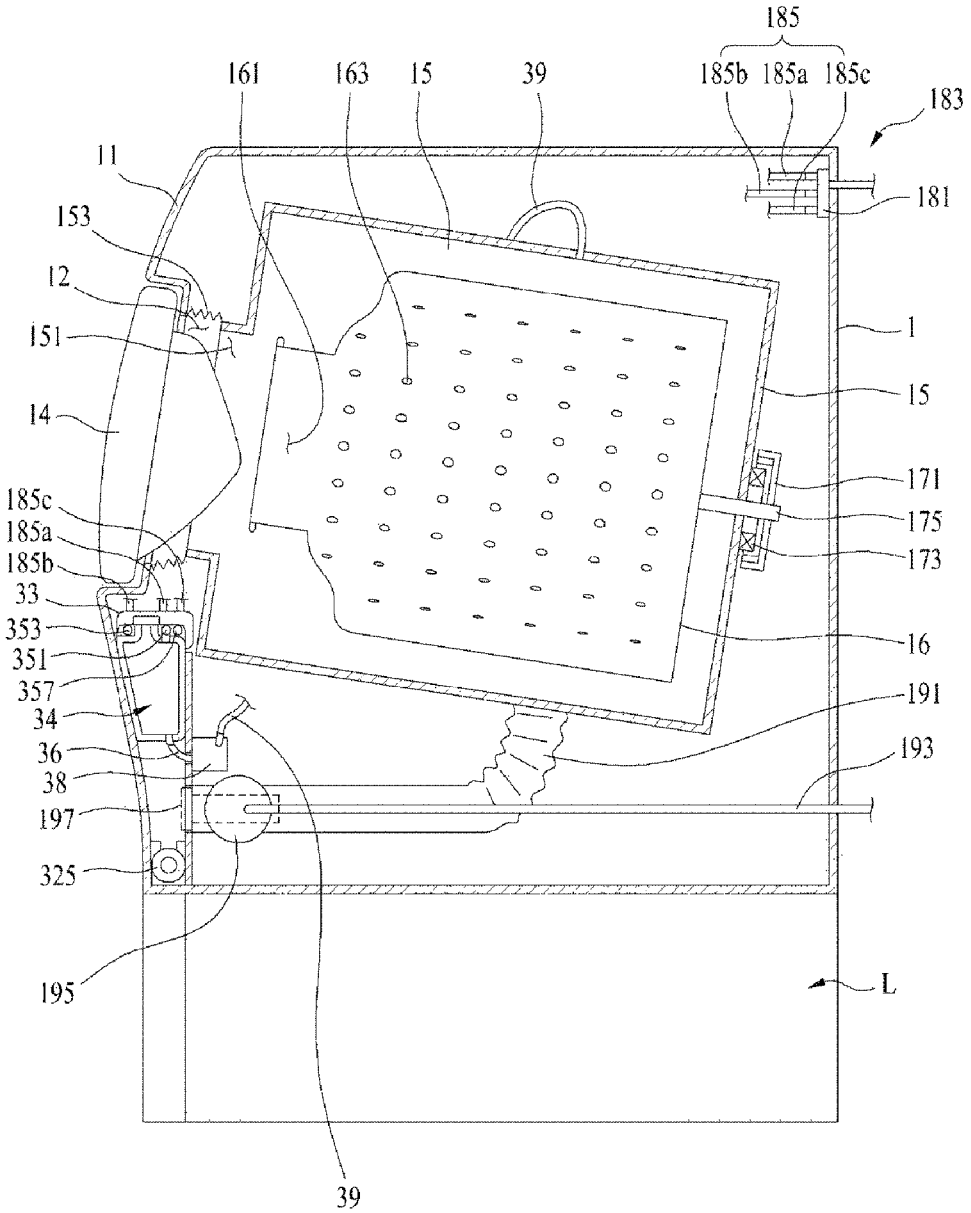

[Fig. 7]
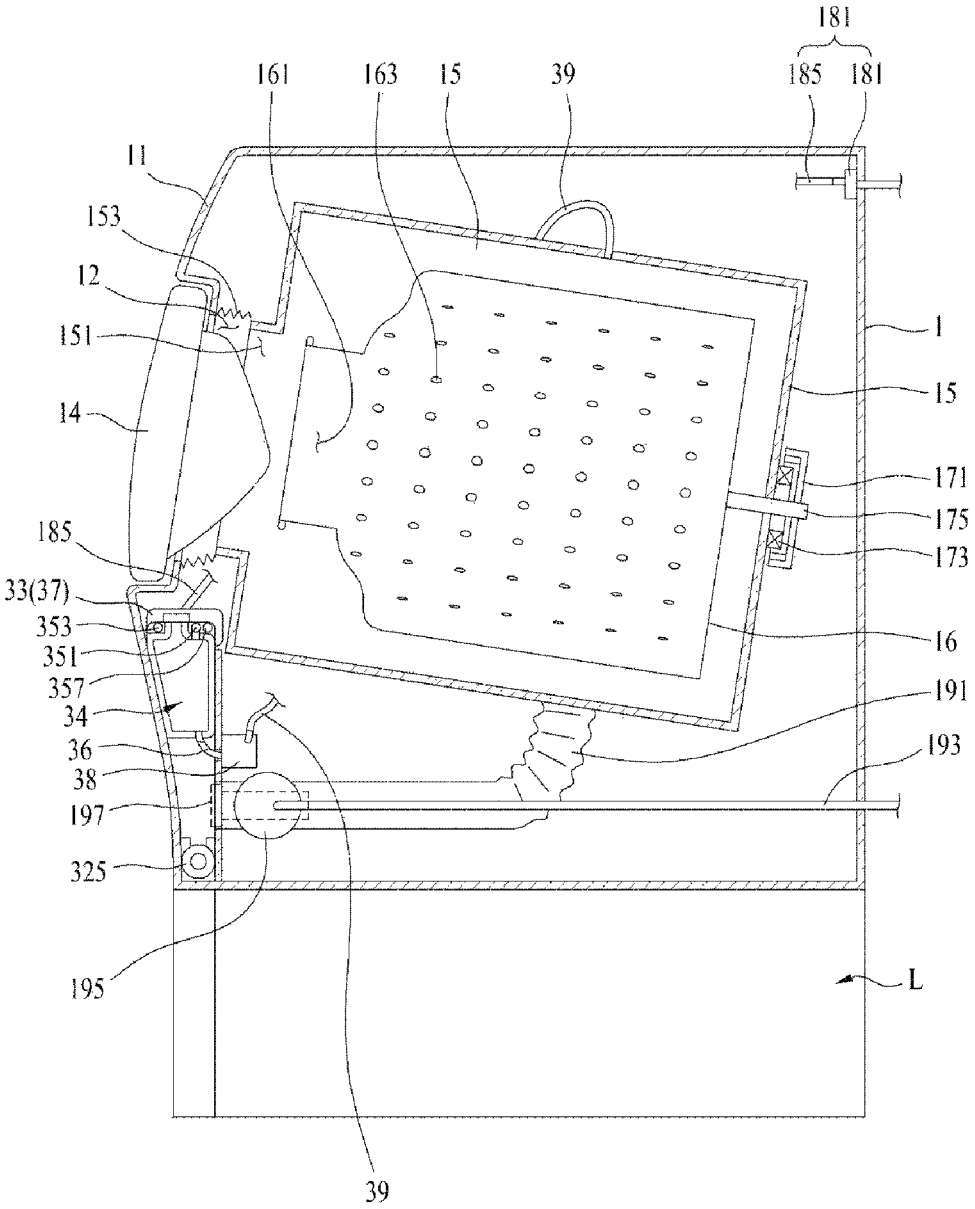

LAUNDRY TREATMENT APPARATUS

FIELD

Embodiments of the present invention relate to a laundry treatment apparatus.

BACKGROUND

Generally, laundry treatment apparatuses include dryers configured to dry drying objects (i.e., laundry or washed clothes) and washers configured to wash washing objects (i.e., laundry). Washers or washing machines out of such laundry treatment apparatuses use detergent for washing laundry. To use detergent, such a washing machine includes a detergent storage unit where detergent is stored.

A conventional laundry treatment apparatus includes a cabinet configured to define a profile of the laundry treatment apparatus, with a laundry entrance hole for loading laundry; a tub provided in the cabinet and configured to store washing water therein; a drum rotatably provided in the tub and configured to receive laundry therein; a water supply unit configured to supply washing water to the tub; and a drainage unit configured to drain the washing water stored in the tub.

Moreover, such a conventional laundry treatment apparatus includes a detergent supply unit configured to supply washing water and detergent simultaneously and mixedly. The detergent supply unit provided in the conventional laundry treatment apparatus is located over the laundry entrance hole. Accordingly, a user has to lift the detergent over the laundry entrance hole inconveniently, to supply it to the detergent supply unit.

DETAILED DESCRIPTION OF THE INVENTION

Technical Problem

To overcome the disadvantages, an object of the present disclosure is to provide a laundry treatment apparatus which may lower the height of the space where detergent is stored.

Technical Solution

To achieve these objects and other advantages and in accordance with the purpose of the embodiments, as embodied and broadly described herein, a laundry treatment apparatus includes a cabinet comprising a laundry entrance hole configured to load laundry into the cabinet; a tub provided in the cabinet and configured to store washing water therein, the tub comprising a tub hole in communication with the laundry entrance hole; a drum rotatably provided in the tub and configured to receive the laundry loaded via the tub hole; a detergent supply unit provided under the laundry entrance hole, in communication with the tub, and configured to store detergent therein; and a water supply unit configured to supply water to the detergent supply unit.

The detergent supply unit may include first, second third storage portions provided under the laundry entrance hole and configured to store detergent therein, in communication with the tub; a first path configured to guide the water supplied by the water supply unit to the first storage portion; a second path configured to guide the water supplied by the water supply unit to the second storage portion and crossing the first path; and a third path extended from a point of intersection between the first path and the second path and configured to supply water to the third storage portion.

The detergent supply unit may further include a distribution valve configured to open and close the first path and the second path and to open the first path and the second path simultaneously, and the water supply unit may be configured to supply water to the distribution valve.

The water supply unit may include a tub supply path configured to supply water to the water; and a storage portion supply path configured to supply water to the distribution valve.

The water supply unit may include a first hose configured to supply water to the first path; a second hose configured to supply water to the second path; and a water supply valve configured to open the first hose and the second hose selectively or to open the first hose and the second hose simultaneously.

The detergent supply unit may include first, second third and fourth storage portions provided under the laundry entrance hole and configured to store detergent therein, in communication with the tub; a first path configured to guide the water supplied by the water supply unit to the first storage portion; a second path crossing the first path and configured to guide the water supplied by the water supply unit to the second storage portion; a third path extended from a point of intersection between the first path and the second path and configured to supply water to the third storage portion; and a fourth path configured to guide the water supplied by the water supply unit to the fourth storage portion.

The detergent supply unit may further include a distribution valve configured to open and close the first path, the second path and the fourth path and to open the first path and the second path simultaneously, and the water supply unit may be configured to supply water to the distribution valve.

The water supply unit may include a tub supply path configured to supply water to the water; and a storage portion supply path configured to supply water to the distribution valve.

The water supply unit may include a first hose configured to supply water to the first path; a second hose configured to supply water to the second path; a third hose configured to supply water to the fourth path; and a water supply valve configured to open the first hose, the second hose and third hose and to open the first hose and the second hose simultaneously.

The laundry treatment apparatus may further include a hole provided in the cabinet, in communication with outside; and a path detachable unit coupled to the cabinet and connected to the water supply unit, wherein the detergent supply unit may further include a hole door configured to open and close the hole; first, second and third storage portions provided in the hole door and configured to store detergent therein; a first path detachably connected to the path detachable unit and configured to supply water to the first storage portion; a second path detachably connected to the path detachable unit, crossing the first path, and configured to supply water to the second storage portion; and a third path extended from a point of intersection between the first path and the second path and configured to supply water to the third storage portion.

The hole may be provided under the laundry entrance hole.

In another aspect of the present disclosure, a laundry treatment apparatus includes a cabinet comprising a laundry entrance hole configured to load laundry into the cabinet; a tub provided in the cabinet and configured to store washing water therein, the tub comprising a tub hole in communication with the laundry entrance hole; a drum rotatably provided in the tub and configured to receive the laundry loaded via the tub hole; a detergent supply unit first, second third storage portions provided under the laundry entrance hole and configured to store detergent therein, in communication with the tub; a first path configured to guide the water supplied by the water supply unit to the first storage portion; a second path configured to guide the water supplied by the water supply unit to the second storage portion and crossing the first path; and a third path extended from a point of intersection between the first path and the second path and configured to supply water to the third storage portion; a path detachable unit coupled to the cabinet and having the first path and the second path detachably connected thereto; and a water supply unit configured to supply water to the first path and the second path via the path detachable unit.

Advantageous Effects

According to at least one of the embodiments of the present disclosure, the laundry treatment apparatus may lower the height of the space where detergent is stored and then the inconvenience of the conventional laundry treatment apparatus can be resolved.

BRIEF DESCRIPTION OF THE DRAWINGS

FIG. 1 is a diagram illustrating a laundry treatment apparatus in accordance with one embodiment of the present disclosure;

FIG. 2 is a diagram illustrating an internal structure of the laundry treatment disclosure in accordance with the present disclosure;

FIG. 3 is a diagram illustrating a detergent supply unit provided in the laundry treatment apparatus in accordance with one embodiment of the present disclosure;

FIG. 4 is a diagram illustrating a laundry treatment apparatus in accordance with another embodiment of the present disclosure; and FIGS. 5 through 7 are diagrams illustrating a laundry treatment apparatus in accordance with a further embodiment of the present disclosure.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. The structure and control method which will be described are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings A laundry treatment apparatus 100 in accordance with exemplary embodiments of the present disclosure may consist of only a first treatment apparatus (T) configured to wash, dry and wash and dry washing objects (i.e., laundry). As shown in FIG. 1, the laundry treatment apparatus 100 may consist of a first treatment apparatus (T) and a second treatment apparatus (L) provided under the first treatment apparatus (T).

The second treatment apparatus (L) may be provided as means for washing or drying laundry like the first treatment apparatus (T) or it may be provided as the accessory necessary for use of the first treatment apparatus or as the space for simply storing laundry.

In any cases, the second treatment apparatus (T) may include a housing 5 configured to define a profile of the second treatment apparatus, with supporting a bottom surface of the first treatment apparatus (T); and a drawer 7 retractable with respect to the housing 5 and configured to store laundry therein.

When the second treatment apparatus (T) is provided as the means for washing laundry, the drawer 7 may include an outer tub configured to store washing water therein; and an inner tub rotatably provided in the outer tub and configured to store laundry therein.

In the housing 5 may be provided water supply means configured to supply washing water to the outer tub and drainage means configured to drain the washing water stored in the outer tub to the housing 5.

Meanwhile, when the second treatment apparatus (T) is able to dry laundry, heated-air supply means may be further provided in the housing 5 to supply heated-air to the outer tub.

As shown in FIG. 2, the first treatment apparatus (T) includes a cabinet 1 configured to define a profile of the first treatment apparatus (T) and located on a top of the second treatment apparatus (T); a tub 15 provided in the cabinet 1 and configured to store washing water therein; a drum 16 rotatably provided in the tub 15 and configured to store laundry therein; and a water supply unit 18 configured to supply water to the tub 15; and a detergent supply unit 3 configured to supply detergent to the tub 15.

A front surface of the cabinet 1 is defined by a front panel 11. A laundry entrance hole 12 for loading laundry into the first treatment apparatus (T) and a laundry entrance hole door 14 for opening and closing the laundry entrance hole 12 may be provided in the front panel 11.

In the front panel 11 may be provided a control panel for inputting a control command to the laundry treatment apparatus 100 and a display unit for displaying operation processes of the laundry treatment apparatus or the control command selected by the user.

The control panel 141 and the display unit (not shown) may be provided in a surface of the laundry entrance hole door 14. In this instance, one of the control panel 141 and the display unit may be provided in the laundry entrance hole door 14 and the other of the two may be provided in the front panel 11.

The tub 15 is the space where the washing water is stored and it includes a tub hole 151 in communication with the laundry entrance hole 12. The tub 15 is fixedly mounted in the cabinet 1, while supported by a tub support unit 155.

The tub hole 151 and the laundry entrance hole 12 are connected with each other by a gasket 153. When it is formed of a flexible material (e.g., rubber) the gasket 153 may prevent the washing water stored in the tub 15 from leaking outside and the vibration of the tub 15 from being transferred to the cabinet 1.

The drum 16 is the means for storing laundry therein and it is cylindrical-shaped, with an empty inside. The drum 16 includes a drum hole 161 in communication with the tub hole 151 and a through hole 163 which penetrates a circumferential surface of the drum 16.

The drum 16 is rotated by a driving unit provided in a rear surface of the tub 15. The driving unit may include a stator 174 coupled to the rear surface of the tub 15, a rotor 171 rotary by a rotation magnetic field generated by the stator 174, and a shaft 175 penetrating the rear surface of the tub 15 to connect rotor 171 to the drum 16.

The water supply unit 18 is the means for supplying water to the detergent supply unit 3. The water supply unit 18 includes a water supply valve 181 connected to a water supply source (not shown) provided outside the laundry treatment apparatus 100 and a water supply path 183 closable by the water supply valve 181.

The water supply path 183 may include a tub supply path 184 configured to connect the water supply valve 181 and the tub 15 with each other and a storage portion supply path 185 configured to connect the water supply valve 181 and the detergent supply unit 3 with each other. In this instance, the water supply valve 181 may be a predetermined type of a valve configured to selectively open and close the tub supply path 184 and the storage portion supply path 185 or simultaneously open and close both of the paths (e.g., two way valve).

The water supply path 183 may include only the storage portion supply path 185. As the detergent supply unit 3 is in communication with the tub 15, the tub 15 may be provided with the water necessary to wash the laundry via the water supply valve 181, the storage portion supply path 185 and the detergent supply unit 3.

Meanwhile, the water supply unit 18 may further include a second water supply path 187 configured to connect a tub 15 and a water supply source (not shown) for supplying hot water with each other. In this instance, the second water supply path 187 may include a second water supply tube 187*a* connected to the tub 15 and a second water supply tube valve 187*b* connected to the hot water supply source and configured to open and close the second water supply tube 187*a*.

The washing water stored in the tub 15 is drained outside the cabinet 1 via the water drainage unit 19. The water drainage unit 19 may include a first drainage path 191 configured to connect the tub 15 and a drainage pump 195 with each other and a second drainage path 913 configured to guide the washing water drained by the drainage pump 195 outside the cabinet.

The detergent supply unit 3 is the means for storing the detergent which will be supplied to the tub 15. The detergent supply unit 3 provided in the laundry treatment apparatus in accordance with the present disclosure is characterized to be located under the laundry entrance hole 12.

In other words, the detergent supply means provided in the conventional laundry treatment apparatus to supply detergent to the tub is located over the laundry entrance hole. Accordingly, the user can feel inconvenient when supplying the detergent necessary to wash the laundry. However, the detergent supply unit 2 provided in the laundry treatment apparatus in accordance with the present disclosure is located under the laundry entrance hole 12, so that the problem of the inconvenience mentioned above can be solved.

The detergent supply unit 3 includes a storage portion 34 located underneath the laundry entrance hole 12 to provide a space where detergent is stored. It is preferred that three or more storage portions 34 are provided in the laundry treatment apparatus in accordance with the present disclosure to store three different kinds of detergents.

FIG. 3 illustrates that four storage portions are provided. Hereinafter, the four storage portions will be described as one example of the storage portion, for convenient explanation sake.

The storage portion 34 in accordance with one embodiment of the present disclosure may include a first storage portion 341, a second storage portion 343, a third storage portion 345 and a fourth storage portion 347 which are partitioned off by a partition wall.

A detergent entrance hole 344 for each of the storage portions 341, 343, 345 and 347 may be provided in the front panel 11 to be exposed outside when the door 14 opens the laundry entrance hole 11. The detergent entrance hole 344 of each storage portion 341, 343, 345 and 347 may include a cover (not shown) so as to open and close the detergent entrance hole 344.

A drainage hole 349 may be provided in a bottom surface of each storage portion 341, 343, 345 and 347 to drain the detergent there out. Each drainage hole is connected to a pump 38 via a drainage path 36. Accordingly, the detergent drained from each of the storage portions by the pump 38 may be supplied to the tub 15 via the detergent supply path 39.

Meanwhile, the storage portions 341, 343, 345 and 347 are provided with water via the water supply path 35. The water supply path includes a first path 351 configured to supply water to the first storage portion 341, a second path 353 crossing the first path 351 and configured to supply water to the second storage portion 343, a third path 355 extended from an point (X) of intersection between the first and second paths and configured to supply water to the third storage portion, and a fourth path 357 configured to supply water to the fourth storage portion 347.

As shown in FIG. 2, the first path 351, the second path 353 and the fourth path 357 are connected to the storage portion supply path 185 through a distribution valve 37.

The distribution valve 37 may not only control the opening and closing of the first, second and fourth paths 351, 353 and 357 but also open the first and second paths 351 and 353 simultaneously.

Accordingly, when only the first path 351 is open by the distribution valve 37, water is supplied only to the first storage portion 341. When only the second path 353 is open, water is supplied only to the second storage portion 343. When only the fourth path 357 is open, water is supplied only to the fourth storage portion 347.

However, when the first path and the second path are open by the distribution valve 37 simultaneously, the water flowing along the first path 351 and the water flowing along the second path 353 may collide at the point of intersection (X) to flow along the third path 355. Accordingly, the water may be supplied to the third storage portion 345.

That is enabled, because the third path 355 is formed along the vector as the sum of the vector force possessed by the water flowing along the first path 351 and the vector force possessed by the water flowing along the second path 353.

The water supplied to the storage portions 341, 343, 345 and 347 together with the detergent stored therein may flow to the tub 15 via the drainage hole 349, the drainage path 36, the pump 38 and the detergent supply path 39.

If the pressure of the water supplied to the paths 351, 353, 35 and 357 by the distribution valve 37 is controlled high, there is no need of the pump 38 and the drainage path 36 mentioned above. In this instance, the detergent supply path 39 is directly connected to the drainage hole 349.

FIG. 4 illustrates a laundry treatment 100 in accordance with another embodiment of the present disclosure.

The water supply path 183 in accordance with this embodiment also includes the tub supply path 184 and the storage portion supply path 185. However, the storage portion supply path 185 in accordance with this embodiment includes a first hose 185*a* connected to the first path 351 of the detergent supply unit, a second hose 185*b* connected to the second path 353 and a third hose 185*c* connected to the fourth path 357, which is the characteristic distinguished from the embodiment described above.

The first hose 185*a*, the second hose 185*b*, the third hose 185*c* and the tub supply path 184 are connected to a water supply source via the water supply valve 181.

The water supply valve 181 is configured not only to control the opening and closing of the hoses 1851, 185*b* and 185*c* and the tub supply path 184 and to open at least the first and second hoses 185*a* and 185*b* of the hoses simultaneously. In other words, this embodiment is characterized in that the water supply valve 181 mentioned above is functioned as the distribution valve 37 of FIG. 2.

Even in this embodiment, it is safe that the tub supply path 184 is omitted. In this instance, it is preferred that the water supply valve 181 is configured not only to open and close each of the hoses 185*a*, 185*b* and 185*c* but also to open at least the first and second hoses 185*a* and 185*b* simultaneously.

FIGS. 5 through 7 illustrate a laundry treatment apparatus in accordance with a further embodiment of the present disclosure.

As shown in FIG. 5, the laundry treatment apparatus in accordance with this embodiment is characterized in that the detergent supply unit 3 is structured to be retractable with respect to the front panel 11.

Specifically, the front panel 11 in accordance with this embodiment may further include a hole 13 provided under the laundry entrance hole 12. The detergent supply unit 3 is provided in a hole door 31 configured to open and close the hole 13.

In this instance, the hole door 31 is rotatably coupled to a support panel (32, which is provided in the hole, with being fixed to the cabinet 1) by a hinge 325. The storage portion 34 configured to store detergent therein may be coupled to the hole door 31 and the pump 38 configured to move the detergent stored in the storage portion 34 to the tub 15 may be coupled to the support panel 32.

A through hole 323 may be provided in the support panel 32 and the drainage path 36 configured to connect the storage portion 34 to the pump 38 penetrates the through hole 323.

The support panel 32 may further include a filter detachable hole 321 penetrating the support panel. A filter 197 detachably provided in the first drainage path 191 to filter the washing water drained from the tub is inserted in a first drainage path 191, so that the user may couple or decouple the filter 197 to or from the first drainage path 191 via the filter coupling hole 321.

The hole door 31 provided in the laundry treatment apparatus in accordance with this embodiment may be configured to open and close the hole 13 at a first angle or a second angle preset larger than the first angle.

The first angle is preset as the angle at which the detergent entrance hole 344 provided in each of the storage portions 341, 343, 345 and 347 is exposed (see FIG. 5 (*a*)) and the second angle is preset as the angle at which the filter 197 provided in the filter coupling hole 321 is exposed (see FIG. 5 (*b*)).

For that, the laundry treatment apparatus in accordance with this embodiment may further include a first stopper 311 configured to allow the hole door 31 to keep the first angle and a second stopper (not shown) configured to allow the hole door 31 to keep the second angle.

The storage portion 34 and the water supply path 35 in accordance with this embodiment may have the same structure as the storage portion and the water supply path shown in FIG. 3. In other words, the storage portion in accordance with this embodiment may include a first storage portion 341 provided with water via the first path 351, a second storage portion provided with water via the second path 353, a third storage portion 345 provided with water via the third path 355 and a fourth storage portion 347 provided with water via the fourth path 357.

As shown in FIG. 6, the storage portion supply path 185 configured to supply water to the paths 351, 353, 355 and 357 may include a first hose 185*a*, a second hose 185*b* and a third hose 185*c*.

In case the storage portion supply path 185 include the three hoses, the first hose 185*a* is connected to the first path 351 and the second hose 185*b* is connected to the second path 353 and the third hose 185*c* is connected to the fourth path 357.

The water supply valve 181 may be configured not only to control the opening and closing of the hoses but also to open the first and second hoses 185*a* and 185*b* simultaneously so as to supply water to the third storage portion 345.

The first hose 185*a*, the second hose 185*b* and the third hose 185*c* can be directly connected to the first path 351, the second path 353 and the fourth path 357, respectively. Only when the laundry entrance hole door 31 is configured to open and close the hole 13, the laundry treatment apparatus in accordance with this embodiment may further include a path detachable unit 33 configured to detachably connect the water supply path 35 and the storage portion supply path 185 with each other.

The path detachable unit 33 is fixed in the cabinet 1. When the hole door 31 has closed the hole 13, the path detachable unit 33 is used as the means for connecting the first hose 185*a*, the second hose 185*b* and the third hose 185*c* of the storage portion supply path 185 to the first path 351, the second path 353 and the fourth path 357 of the water supply path, respectively.

FIG. 7 illustrates that the storage portion supply path 185 is configured as one path.

In this embodiment, the first path 351, the second path 353 and the fourth path 357 provided in the detergent supply unit 3 may be detachably connected to the first hose 185*a*, the second hose 185*b* and the third hose 185*c* provided in the path detachable unit 3, respectively. The storage portion supply path 185 may be connected to the distribution valve 37 and the distribution valve 37 may open and close the hoses 185*b*, 185*b* and 185*c* provided in the path detachable unit. In this instance, the distribution valve 37 has to be configured to open the first hose 185*a* and the second hose 185*b* simultaneously.

Meanwhile, in this embodiment, the path detachable unit 33 may be functioned as the distribution valve 37. In this instance, the distribution valve 37 may be omitted and the storage portion supply path 185 has to be connected to the path detachable unit 33.

When a particular feature, structure, or characteristic is described in connection with any embodiment, it is submitted that it is within the purview of one skilled in the art to affect such feature, structure, or characteristic in connection with other ones of the embodiments.

What is claimed is:

1. A laundry treatment apparatus comprising:

a cabinet comprising a laundry entrance hole configured to load laundry into the cabinet;

a tub provided in the cabinet and configured to store washing water therein, the tub comprising a tub hole in communication with the laundry entrance hole;

a drum rotatably provided in the tub and configured to receive the laundry loaded via the tub hole;

a detergent supply unit provided under the laundry entrance hole, in communication with the tub, and configured to store detergent therein;

a water supply unit configured to supply water to the detergent supply unit; and a hole provided under the laundry entrance hole, in communication with outside of the cabinet, wherein the detergent supply unit comprises:

a support panel which is provided in the hole, and fixed to the cabinet;

a hole door rotatably coupled to the support panel by a hinge to open and close the hole at a first angle or a second angle preset larger than the first angle;

a storage portion coupled to the hole door and configured to store detergent therein; and a pump coupled to the support panel and configured to move the detergent stored in the storage portion to the tub.

2. The laundry treatment apparatus of claim 1, wherein the storage portion comprises first, second and third storage portions in communication with the tub, and wherein the detergent supply unit further comprises:

a first path configured to guide the water supplied by the water supply unit to the first storage portion;

a second path configured to guide the water supplied by the water supply unit to the second storage portion and crossing the first path; and a third path extended from a point of intersection between the first path and the second path and configured to supply water to the third storage portion.

3. The laundry treatment apparatus of claim 2, wherein the detergent supply unit further comprises a distribution valve configured to open and close the first path and the second path, and to open the first path and the second path simultaneously, and wherein the water supply unit is configured to supply water to the distribution valve.

4. The laundry treatment apparatus of claim 3, wherein the water supply unit comprises:

a tub supply path configured to supply water to the tub; and a storage portion supply path configured to supply water to the distribution valve.

5. The laundry treatment apparatus of claim 1, wherein the storage portion comprises first, second, third and fourth storage portions in communication with the tub, and wherein the detergent supply unit further comprises:

a first path configured to guide the water supplied by the water supply unit to the first storage portion;

a second path crossing the first path and configured to guide the water supplied by the water supply unit to the second storage portion;

a third path extended from a point of intersection between the first path and the second path and configured to supply water to the third storage portion; and a fourth path configured to guide the water supplied by the water supply unit to the fourth storage portion.

6. The laundry treatment apparatus of claim 5, wherein the detergent supply unit further comprises a distribution valve configured to open and close the first path, the second path and the fourth path and to open the first path and the second path simultaneously, and wherein the water supply unit is configured to supply water to the distribution valve.

7. The laundry treatment apparatus of claim 6, wherein the water supply unit comprises:

a tub supply path configured to supply water to the tub; and a storage portion supply path configured to supply water to the distribution valve.

* * * * *